United States Patent [19]

Sergeant et al.

[11] Patent Number: 4,879,810

[45] Date of Patent: Nov. 14, 1989

[54] METHOD FOR ELECTRICAL WIRING UTILIZING WIRE RETAINER

[75] Inventors: Ronald G. Sergeant, Miami, Fla.; Allen F. VanDerStuyf, Kernersville, N.C.

[73] Assignee: AMP Incorporated, Harrisburg, Pa.

[21] Appl. No.: 134,325

[22] Filed: Dec. 17, 1987

[51] Int. Cl.[4] ..... H01R 43/04

[52] U.S. Cl. ..... 29/861; 29/866

[58] Field of Search ..... 29/749, 751, 753, 755, 29/861, 866, 867

[56] References Cited

U.S. PATENT DOCUMENTS

| | | |
|---|---|---|
| 3,772,571 | 11/1973 | Merry et al. . |
| 3,871,072 | 3/1975 | Folk . |
| 3,887,999 | 6/1975 | Ross et al. . |
| 3,891,013 | 6/1975 | Folk et al. . |
| 3,970,354 | 7/1976 | Hopkins et al. . |
| 4,076,365 | 2/1978 | Ross et al. . |
| 4,094,566 | 6/1978 | Dola et al. . |
| 4,125,137 | 11/1978 | Shatto, Jr. . |
| 4,132,251 | 1/1979 | Folk et al. . |
| 4,132,252 | 1/1979 | Shatto, Jr. . |
| 4,181,384 | 1/1980 | Dola et al. . |
| 4,367,909 | 1/1983 | Shatto, Jr. et al. . |
| 4,387,509 | 6/1983 | Dechelette . |
| 4,614,028 | 9/1986 | Rich . |
| 4,684,765 | 8/1987 | Beck et al. ..... 174/68.5 |

OTHER PUBLICATIONS

European Patent Office Search dated 7/22/88.
U.S. Application Serial No. 134,328 filed 12-17-87.

*Primary Examiner*—Timothy V. Eley
*Attorney, Agent, or Firm*—Eric J. Groen

[57] ABSTRACT

Method and apparatus embrace loading electrical conductor wires (100) into a wire retainer (36) which in turn is made to engage and become part of a frame (30) having grooves (37) therein and apertures (34, 35) adapted to receive the retainer and/or components (120) which are terminated to wires implanted in said grooves. The wire retainer may be in the form of a simple wire organizer or an electrical connector. Wire implantation via rolling is taught wherein a roller (114) is driven to cause frame movement beneath the roller.

10 Claims, 10 Drawing Sheets

62
63
60
74
66
68
64
100
38
52
40
50
44
42
48
39

100
60
100
60
52
85
40
100
44
38
39
100
48
40
84
52
85

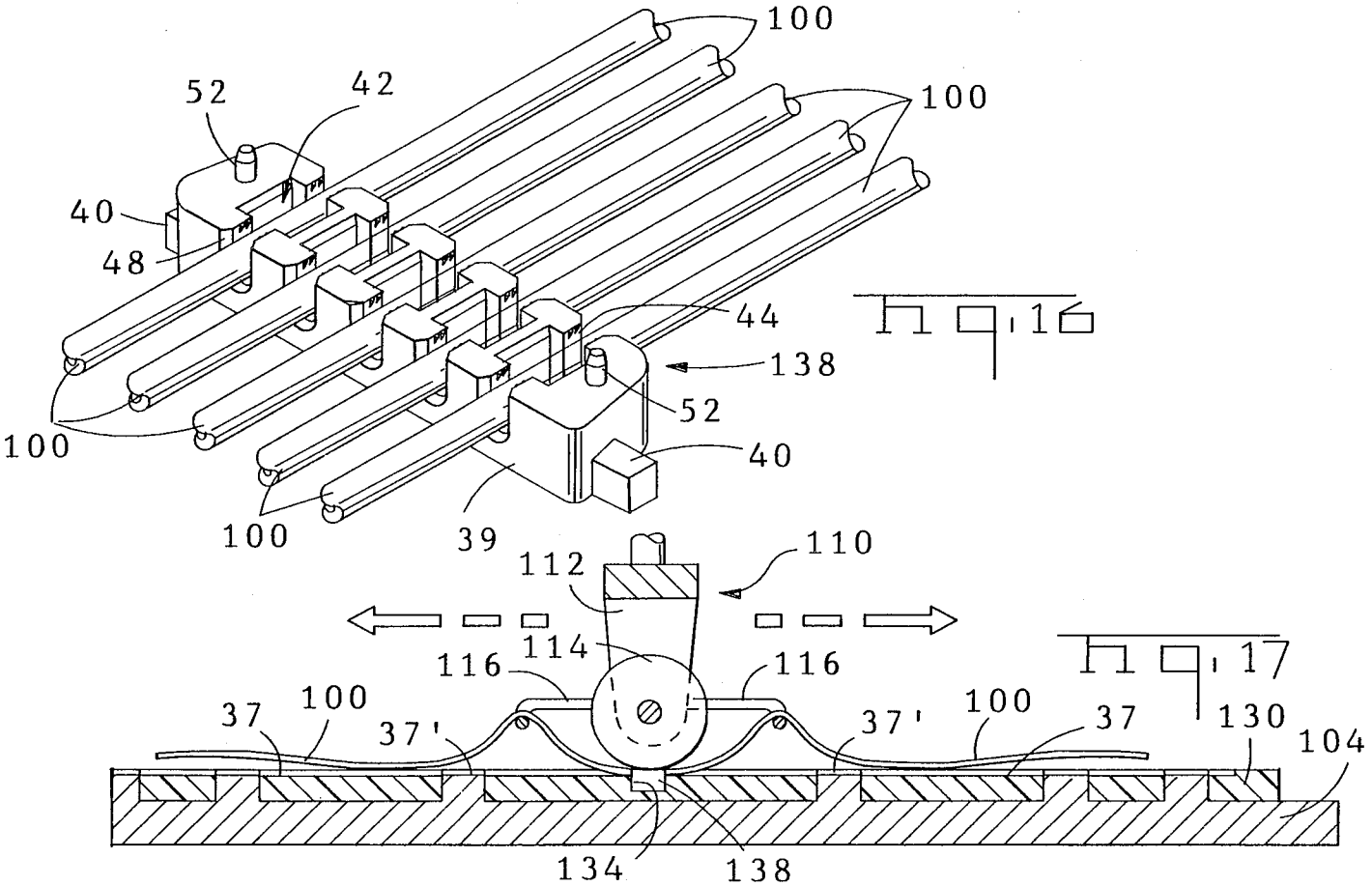
100
100
100
100
100
42
52
40
48
44
138
52
40
39
110
112
114
116
116
37'
37'
100
100
37
37
130
104
138
134
16
17

METHOD FOR ELECTRICAL WIRING UTILIZING WIRE RETAINER

The present invention relates to a method and apparatus for harness making wherein the electrical conductor wires which form the harness are caused to be affixed to a wire retainer with a segment of each wire locked to such retainer with the retainer made to engage a frame which is grooved in a pattern to define a wiring harness. The frame is a structural member of an apparatus served by the harness and is made to contain apertures into which are fitted various components. The wire retainer may be an electrical connector or, alternatively, a simple plastic housing mechanically attached to the wire segments. The invention method embraces rolling as a method of wire implantation, with the roller being made to drive the frame in relative movement so that wire rolling and frame movement are accommodated in a much simplified manner than with respect to the prior art.

BACKGROUND OF THE INVENTION

The use of wire rolling techniques to position wires on centers for subsequent termination to handle twisted pair wires in respect to bulk cable is taught in a number of U.S. Patents including U.S. Pat. Nos. 3,891,013 and 3,871,072. U.S. Pat. No. 4,076,365 also teaches the spreading of wire conductors for the purpose of location for termination wherein there are grooves provided in a connector housing into which conductor wires are driven. U.S. Pat. No. 4,132,251 teaches a similar concept but uses a tool which rolls the wires into grooves.

Pertinent also is U.S. Pat. No. 4,387,509 which deals with a method of manufacturing an electrical interconnection assembly wherein wires are laid in grooves in a substrate tool, with the wires being subsequently transferred from the grooved element to terminals carried by an insulating support to form the assembly.

In U.S. patent application Ser. No. 134,328 (Attorney Docket 13905) co-filed with the present application and assigned to the same assignee, there is taught the concept of using the rolling technique in conjunction with an element which is a structural member of the apparatus served by the harness made up of wires implanted in grooves in such structural element. In our copending application, the concept of using the structural element as a frame in conjunction with a tool having grooves which mate with grooves in the frame is taught in order to provide the ability to have free standing wires. The tool in that case is visualized as being mounted upon the wire laying jig upon which the frame is also mounted. There, rolling techniques are employed in conjunction with the loading of terminals and connectors and components, all related to an apparatus served by the structural element.

The present invention represents an improvement over the foregoing prior art in that it ensures an accurate and less costly technique of wire handling for harness making.

Accordingly, it is an object of the present invention to provide a novel method and apparatus for harness making which simplifies wire placement and lay-up. It is a further object to provide a novel and automation compatible technique and article which assists in the placement of wires into frames containing grooves and in conjunction with wire implantation. It is still a further object of the invention to provide wiring aides in the form of wire retainers and organizers which are compatible with existing wire handling equipment capable of measuring, cutting, stripping, and termination of multiple individual conductor wires. It is yet a further object to provide a method which simplifies the wire rolling mechanism in terms of size and cost, employing a novel method and frame apparatus.

SUMMARY OF THE INVENTION

The present invention teaches a method of forming electrical wiring harnesses by implanting electrical conductor wires into grooves laid out in a desirable to effect wire distribution. Such grooves are formed at least in part in elements which have a structural function relative to apparatus served by the wiring harness in one embodiment. In conjunction therewith, a wire organizer in the form of a simple plastic housing having wire retention means is taught, with a segment either at the ends or intermediate the ends of individual wires being captured and retained as a subassembly. The structural element is made to include surfaces which allow the wire retainer to be fitted therein with the grooves containing the segments of the wires in alignment with grooves in the structural element. This feature is taught in relation to the retainer being placed in an aperture in the frame element or alternatively, plugged into the end of the frame element. In one embodiment, the wire retainer is made to include preloaded terminals having insulation displacement slots therein to be terminated to the wires in such retainer connector. The structural element is made to contain other apertures adapted to receive components carrying slotted terminals therein to engage and terminate to the wires laid in the element. In accordance with the method of the invention, a roller is brought to bear against the wire retainer, with the wires therein thereafter being displaced into the grooves of the structural element by rotation of the roller which additionally displaces the structural element.

The wire implantation effected by the rolling action and the method of the invention can be implemented in accordance with the article of the invention at either end or in between the ends of the structural element, with movement in one direction effecting one sweep; or movement in more than one direction effecting more than one sweep by the roller over the surfaces of the wire organizer retainer, and the structural element.

BRIEF DESCRIPTION OF THE DRAWINGS

FIG. 3 is a view similar to FIG. 2 but with components removed.

FIG. 16 is a view of a wire retainer as applied in the mid span of various conductor wires.

FIG. 17 is a schematic and side view of the wire retainer and wire subassembly of FIG. 16 as applied to a structural element made to accommodate the retainer between the ends thereof and employed with two directions of relative movement between roller and wiring element.

DETAILED DESCRIPTION OF THE INVENTION

Figure 1:
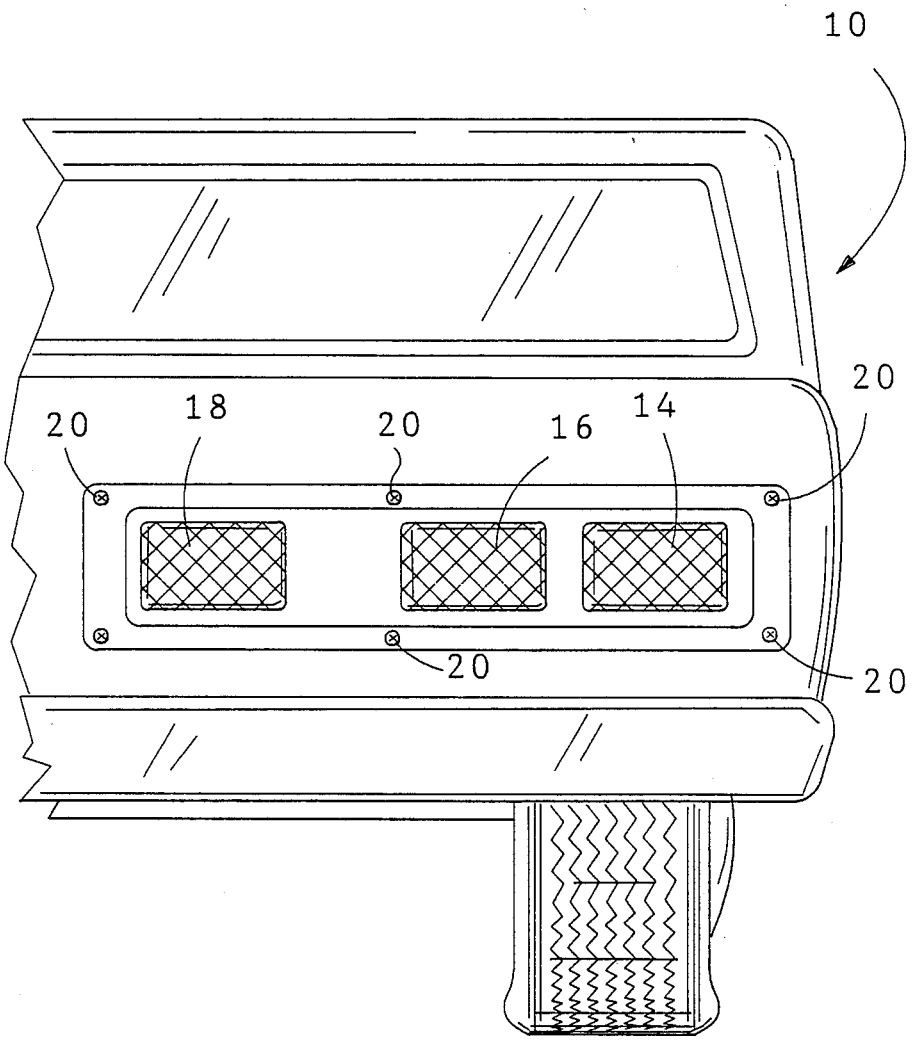
FIG. 1 is an end view of the rear of a vehicle containing a lamp assembly utilizing the present invention.

Referring now to FIG. 1, there is shown a vehicle 10, the right-hand rearward portion thereof containing a lamp assembly 12 which serves the function of providing stop, turn and reverse signals for vehicle 10. The lamp assembly 12 is intended to typify a wide range of assemblies which contain components terminated to the wire harnesses in order to provide power and signal functions, such as home electrical appliances, automobile harness assemblies, and the like.

Figures 2, 7:
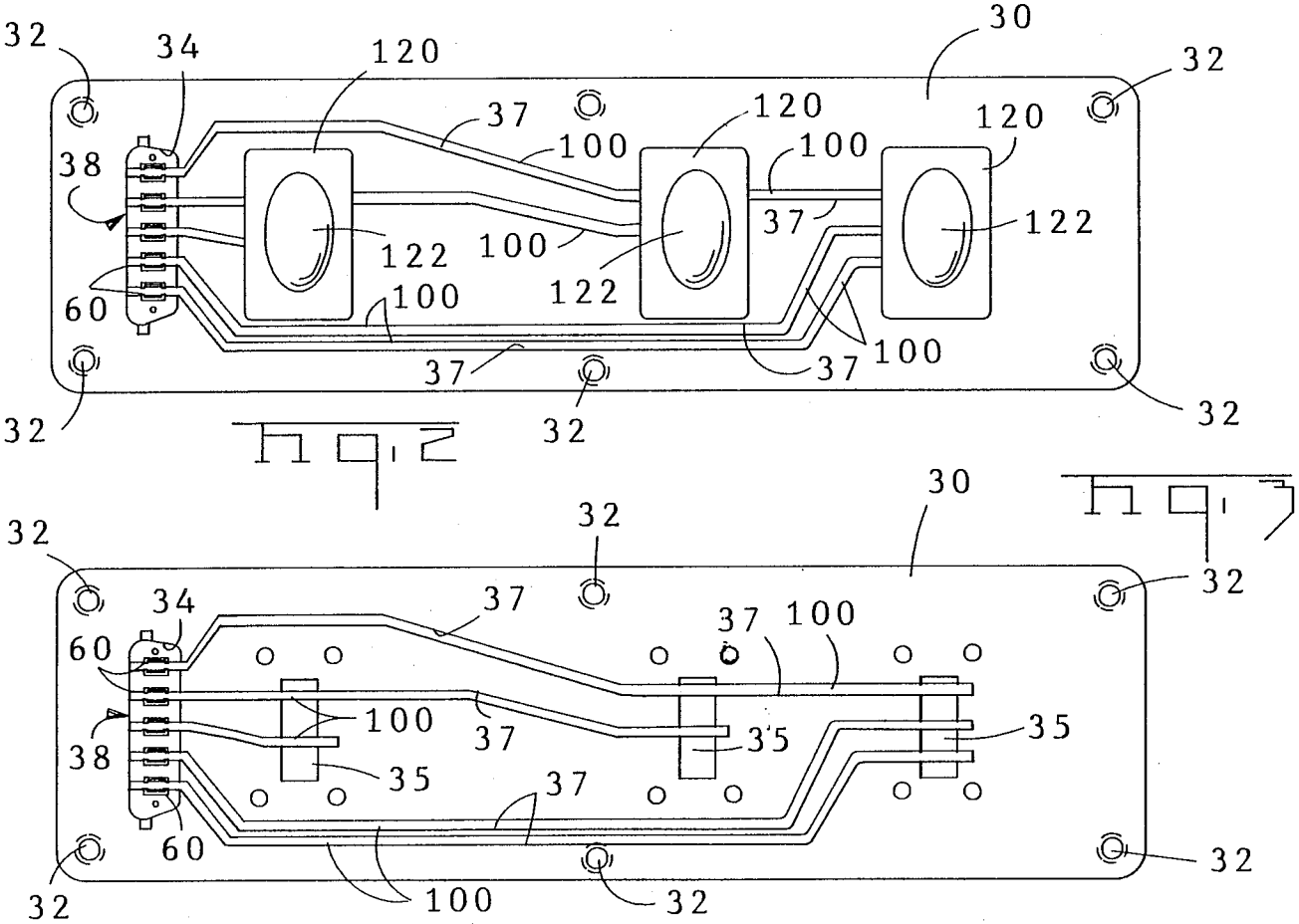
FIG. 2 is a view of the lamp assembly in plan with the protective lens cover removed to show an invention article.
FIG. 7 is a view similar to that of FIG. 6, but showing the wire retainer loaded with terminals.

With reference to a specific embodiment as shown in FIG. 2, the assembly 12 includes a series of three lens structures 14, 16 and 18, beneath which structures are provided incandescent lamps powered to achieve the foregoing mentioned functions. The assembly includes a series of fasteners shown as 20 which lock the assembly together and to the vehicle body frame. FIG. 2 shows a part of the assembly heretobefore mentioned with the lens structures removed to reveal a frame 30 including apertures 32 intended to be engaged with the fastening means 20. To the left of the frame 30 as shown is a first aperture 34 which in this illustrative embodiment, is intended to accommodate the insertion of a wire organizer or retainer 38 which fits within such aperture. As can be seen in FIG. 2, a number of lamp assemblies 120 are mounted to frame 30, with each of the lamp assemblies 120 containing a plug-in lamp 122. A number of grooves 37 are provided in the upper surface of 30 extending from the aperture 34 across the face of 30 in a pattern to position conductor wires 100 so as to interconnect the various components. The assemblies 120 would include terminals similar to those to be described as elements 60 hereafter to follow.

FIG. 3 shows the components for 120 and lamps 122 removed to reveal apertures 35 in the frame element 30, with the wires 100 extending appropriately to permit termination to terminals of the components.

Figure 4:
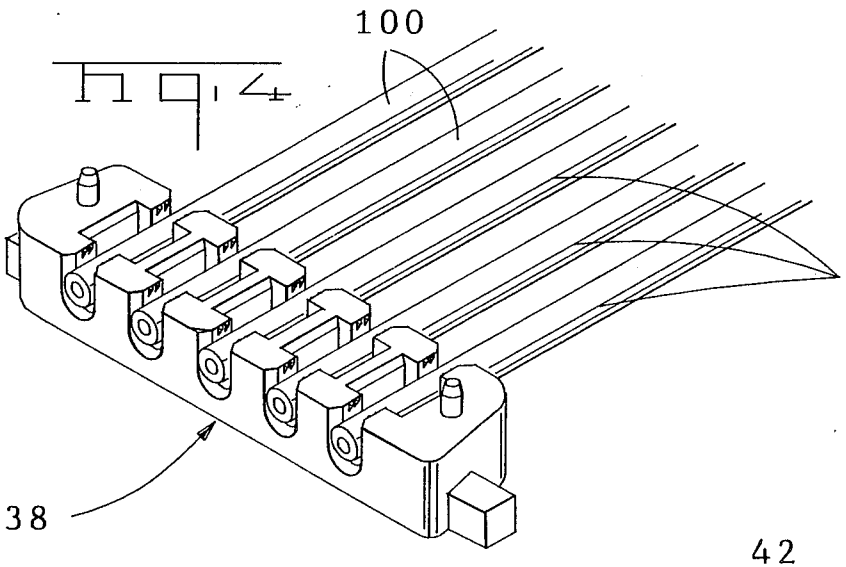
FIG. 4 is a plan view of a wire retainer having wires therein, the retainer having been removed from the assembly shown in FIGS. 2 and 3.
Figure 5:
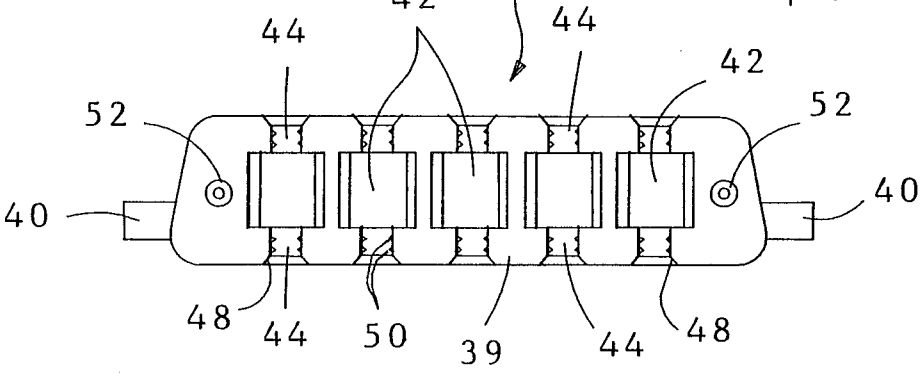
FIG. 5 is a plan view of an illustrative embodiment of a wire retainer.

FIG. 4 shows the wire retainer 38 with terminals 60 removed and with the wires 100 positioned therein preparatory for wire layment. As can be discerned, the assembly represented in FIG. 4 is comprised simply of insulated wires 100 and a wire retainer 38. The wire retainer can be seen in additional detail in FIGS. 5 and 6 to be comprised of a body element or housing 39 containing at the ends thereof small projections 40 which, in conjunction with the shape of 39, serve to polarize or orient the retainer relative to mounting in the aperture 34 of the frame 30. The housing 39 includes additionally a series of apertures shown as 42 which may be considered to extend through the body 39 of the retainer. Adjacent each end of the apertures 42 are grooves shown as 44 which receive conductor wires positioned therein in the manner depicted in FIG. 4. Each of the grooves has a beveled wire entry surface shown as 48 and toward the center of the groove, projections shown as 50 and are better revealed in FIG. 6. These projections operate to capture and retain the wires inserted within the grooves in the manner indicated in FIGS. 5 and 6. In addition, included at each end of the housing 39 are projections shown as 52 which serve the function of orienting and locking terminal protecting housings 80 onto the retainers 39, to be described more fully herein.

Figure 6:
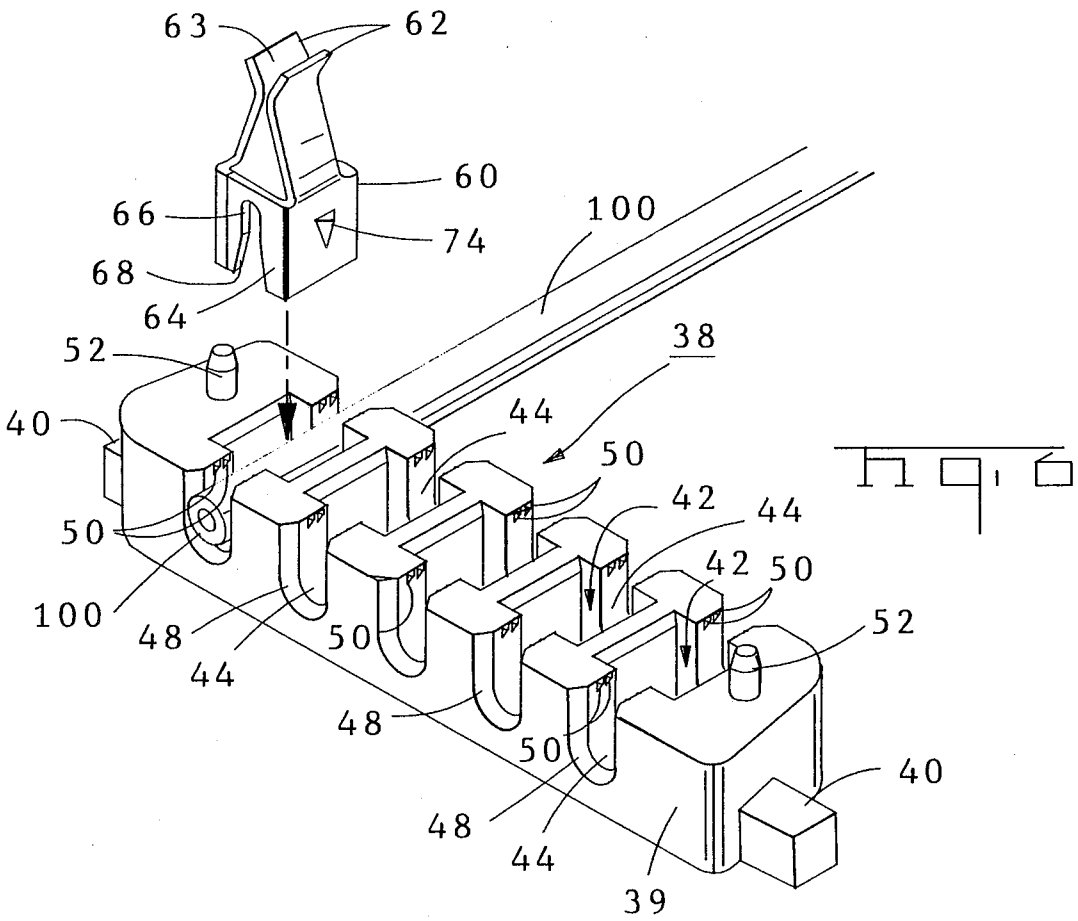
FIG. 6 is a much enlarged perspective view showing an end of the wire retainer shown in FIGS. 2–5, with a slotted beam terminal positioned preparatory to termination of a wire laid in the wire retainer.
Figure 7:
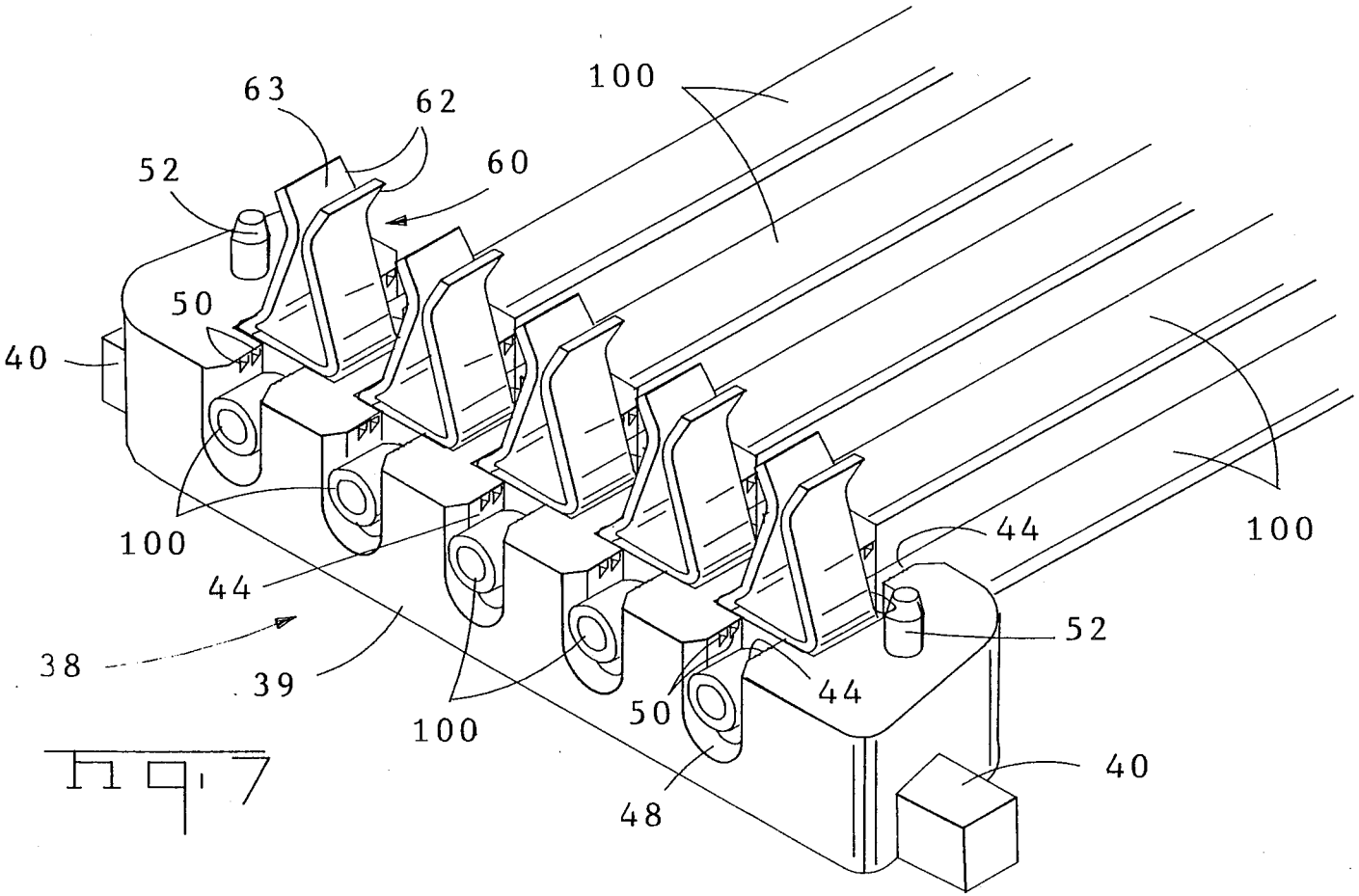

In FIG. 6, the terminal much enlarged from actual size is shown as 60 to include a pair of contact springs 62 suitable formed to provide a funnel entry 63 adapted to receive contact tabs from a mating connector not shown. The terminal 60 includes a boxlike structure having at each end a slot 66 dimensioned to function in the well-known IDC manner to terminate wires such as 100 by stripping the outer sheath of insulation thereof and engaging the strands with sufficient resilient spring pressure to maintain a gas-tight termination over the life of the terminal. The slots 66 open into a beveled portion shown as 68 which tend to center the wire to aid in positioning and engagement with the slots. Terminals 60 include one or more lances shown as 74, dimensioned and positioned to engage the interior surfaces of the aperture walls 42 to lock the terminals to the housings 39 of wire retainer 38.

Figure 8:
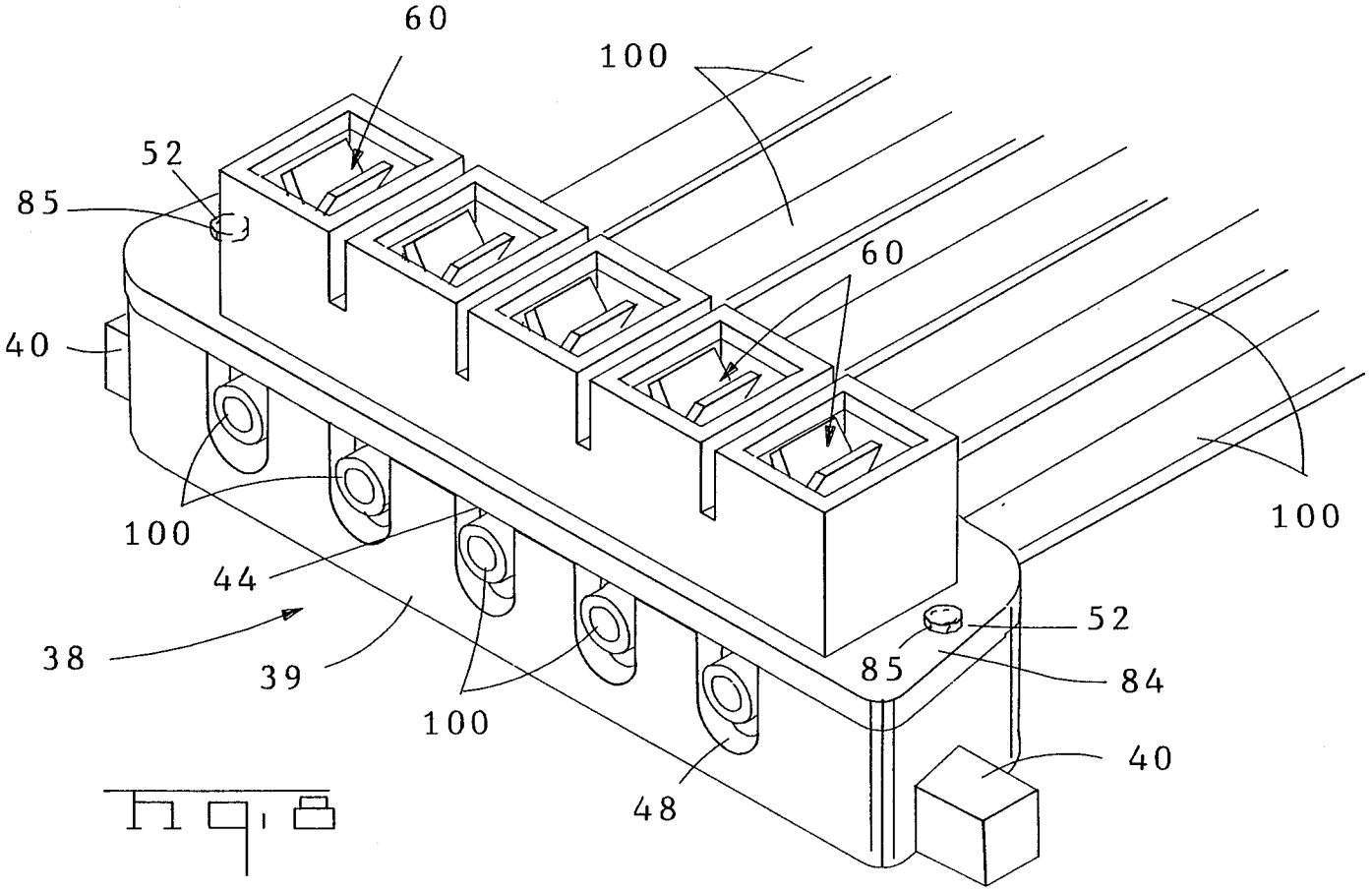
FIG. 8 is a view similar to that shown in FIGS. 6 and 7, but with the wire retainer loaded with terminals and a housing affixed thereto to insulate such terminals.

FIG. 7 shows the wire retainer 38 loaded with terminals 60 to terminate the wires 100 carried therewithin. FIG. 8 shows the loaded wire retainer having additionally a protective insulating housing positioned over the terminals, such housing being shown as 80 which is particularized for the several terminals with the spacing shown as 82 therebetween. Additionally, there is included a flange element shown as 84, apertured as at 85 to fit over the plastic post element 52 which is in a preferred embodiment, heat-staked as shown in FIG. 8 to lock the housing to the wire retainer. Power or signal wires connected to terminals not shown would be plugged into the various terminals 60 to provide inputs and outputs to the circuit.

In conjunction with the invention method and article, it is contemplated that the wire retainer 38 may be incorporated into a frame with the terminals 60 added thereafter. Alternatively, it is contemplated that the wire retainer may be utilized on wire handling equipment with the wires 100 cut and terminated and loaded into the wire retainer as shown in FIG. 4, with the terminals then added with or without a housing 80 which may be added following terminal insertion or at a later time. In this event, the wire retainer, as terminated, may be loaded into the aperture 34 of frame 30. As can be observed from FIGS. 2 or 3, the grooves in the wire retainer shown as 44 are aligned with the grooves 37 in the frame. By insertion of the wire retainer containing wire segments into the frame, the wire segments may be considered started to allow wire implantation into the grooves 37 by a number of means in accordance with the prior art. In the event that the terminals have been pre-applied to the wire retainer 38, it will be necessary to manually or through the use of a robotic assist insert a further segment of the wire just adjacent the wire retainer in the beginning segment of grooves 37 with the roller then applied to the surface of the frame adjacent such wire retainer. It is fully contemplated that the wire retainer may be used alone without terminals, as a wire organizer, and as a means to facilitate processing of subassemblies or with the terminals applied following wire insertion.

Figure 9:
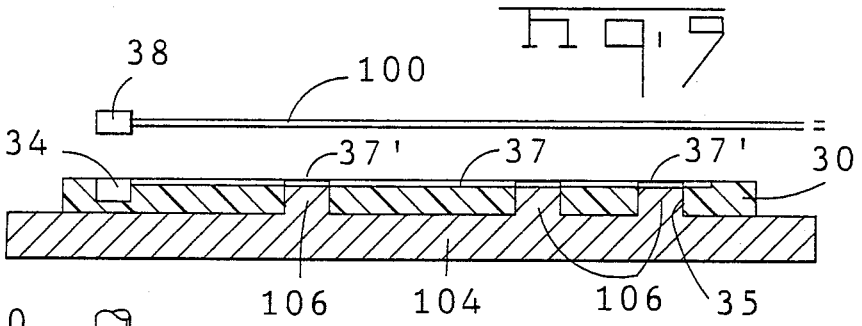
FIG. 9 is a schematic and side view showing a structural element mounted upon a jig preparatory to the loading of a wire retainer and wire therein.
Figure 10:
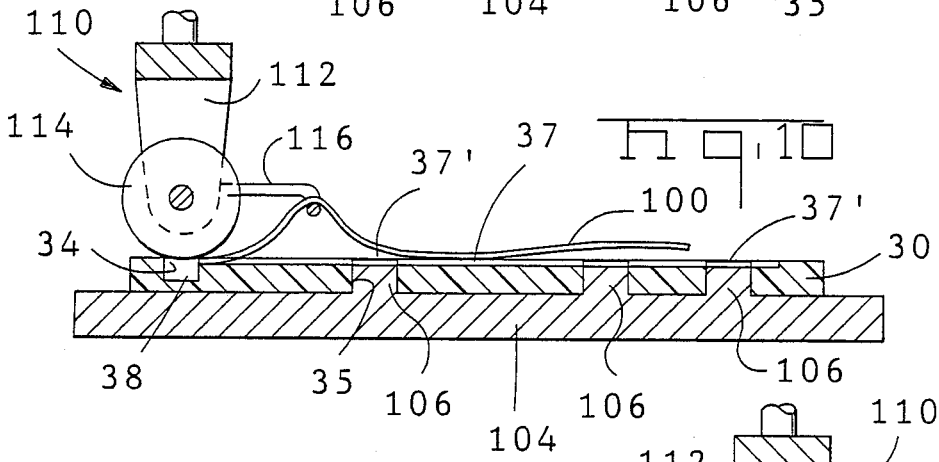
FIG. 10 is a view similar to that of FIG. 9 but with the wire retainer in place and a wire implantation roller bearing against such retainer.

Referring now to FIG. 9, the frame 30 can be seen to be positioned upon a jig shown as 104 having a series of projections 106 which fit into the apertures 35 of the frame. These projections include in their upper surfaces, grooves 37' which match the grooves 37 in the frame 30. As shown in FIG. 9, a wire retaining element 38 is positioned above the frame 30 having the wires 100 captured therein. With regard to the showing in FIG. 9, the jig 104 may be considered to be fixed against displacement. In FIG. 10, the wire retainer 38 is shown inserted within the aperture 34 with portions of the wires 100 made to come up out of the grooves 44, with each wire aligned with an appropriate groove 37. There is provided in FIG. 10 a roller assembly shown as 110. The roller assembly 110 includes a pair of brackets 112 carrying therebetween a roller shown as 114 and a wire bail assembly shown as 116. It is to be understood that the bail 116 is readily opened to accommodate the insertion of the wires 100 in the manner shown in FIG. 10. It is to be further understood that the roller 114 is sufficiently elastic to deform to depress the wires well within the grooves 37. Reference may be had to our copending case for these details.

Figure 11:
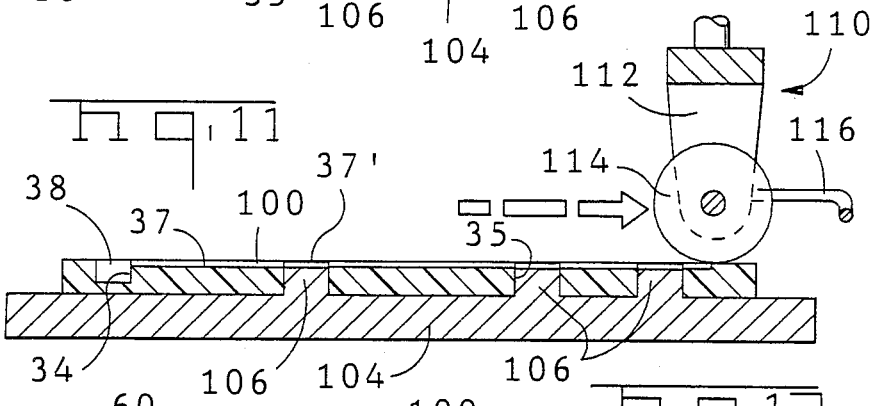
FIG. 11 is a view similar to FIG. 10 with the roller displaced to effect wire implantation.

With the roller assembly 110 positioned as shown in FIG. 10 and bearing down upon the top of the wire retainer 38, it is then driven to the right as shown in FIG. 11 to force the wires 100 within the grooves 37, such wires tracking within the grooves 37' of the jig fixtures 106 as the roller moves over the apertures 35.

Figure 12:
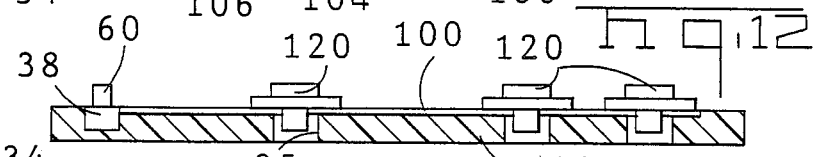
FIG. 12 is a view of the structural element containing the wire with components added thereto.
Figure 13:
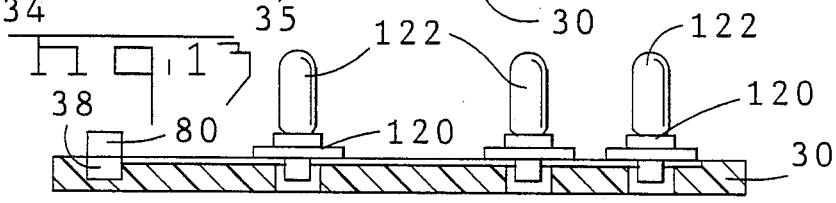
FIG. 13 is a view similar to FIG. 12 with additional components attached thereto.

Following the movement shown in FIG. 11, the wires are now positioned in their patterns and in accordance with the invention, terminals 60 may be applied to terminate the wires in the manner shown in FIG. 12. Also at this particular point, component housings containing suitable IDC terminals may be applied such as lamp housings 120, also as shown in FIG. 12. Thereafter, as shown in FIG. 13, housings 80 may be secured to the wire retainer means as heretofore described and the bulbs or lamps 122 may be inserted in the lamp housings 120 using terminals not shown but similar to terminals 60. As thus shown in FIG. 13, the assembly is as was described relative to FIG. 2 and ready for application to the vehicle and the lamp assembly 12. Alternatively the unit could accept at this point switches, relays, timers, integrated circuit packages, and the like, depending upon the application of the frame. At this point in time, a suitable connector not shown will be plugged into the terminal 60 to make the unit functional. Alternatively, the unit shown in FIG. 13 may be tested for continuity and stacked or handled for loading during assembly of the vehicle on a production line.

Figure 14:
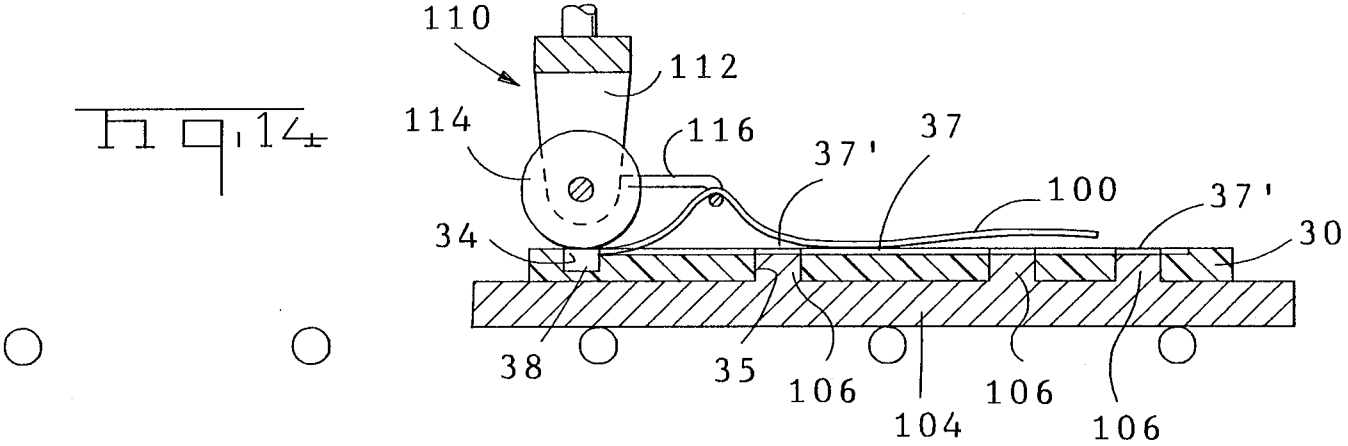
FIG. 14 is a view similar to that of FIG. 10 but employing an alternative method of roller operation.
Figure 15:
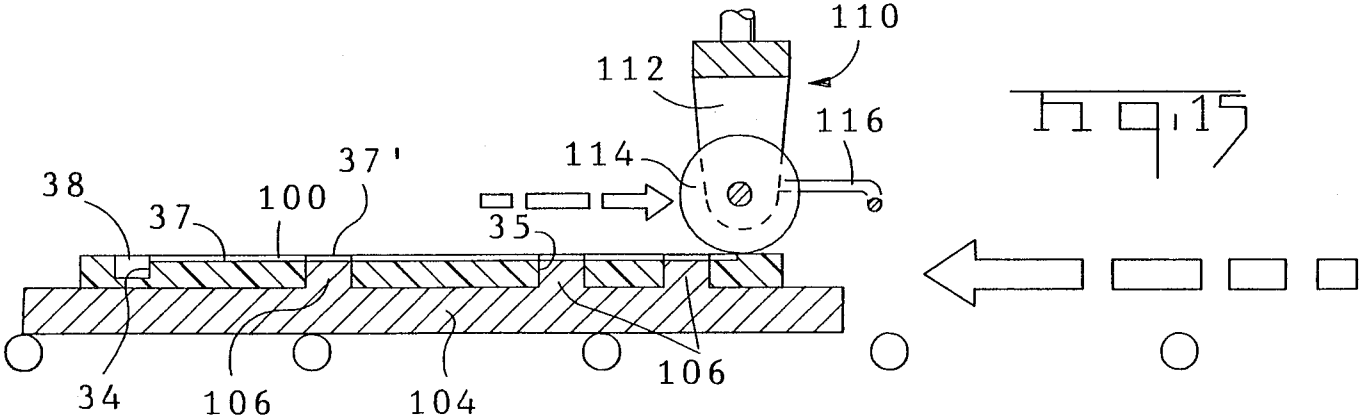
FIG. 15 is a schematic and side view of an end of the wiring element in conjunction with the roller following the wire rolling operation.

FIG. 14 refers to an alternative method wherein the jig 104 is mounted for displacement while the roller assembly is relatively fixed against movement in an X and Y sense, there being a suitable mechanism to move roller assembly 110 vertically as indicated to bring it to bear against the top of the frame 30 and/or the wire retainer 38. As heretofore described relative to FIG. 9, the wire retainer containing wires 100 is first loaded into the top of the frame as positioned upon the jig 104. Next, in accordance with the invention, a drive not shown which could be manually effected is made to force the jig 104 to the left to a position as shown in FIG. 15, the roller traversing the upper surface of the frame 30 effecting wire layment into the grooves thereof.

It is contemplated that the wire rolling assembly 110 may be provided with a rotary drive by suitable means not shown, which in turn will track against the upper surface of frame 30, moving the frame and the jig 104 as the roller implants the wires 100 in such frame. As can be appreciated, this concept vastly simplifies the mechanism employed to utilize the rolling concept. Various jigs of appropriate height having appropriate means to lock frames thereupon may thus be employed with a roller or sets of rollers without the need for extensive closely toleranced spans of wire laying tracks and guides as heretofore required.

FIG. 16 shows an embodiment of the invention, article and concept wherein the wires 100 are loaded into the wire retainer 138 intermediate the ends of the wires rather than at the ends as heretofore described. In accordance with the concept of FIG. 16, a frame shown as 130 in FIG. 17 would be made to have an aperture 134 located intermediate the ends of the frame 130, with the retainer being first plugged in and the different ends of the wires 100 fed through an appropriate bail 116 on each side of the roller, with the roller of assembly 110 then being brought down to bear against the upper surface of 38 and either the jig 104 displaced or the roller actuated to effect the first wire layment in one direction followed by a wire layment in a second direction. This concept is particularly useful wherein the wires 100 are of different lengths and begin or end in a non-even location in a given frame member.

Figure 18:
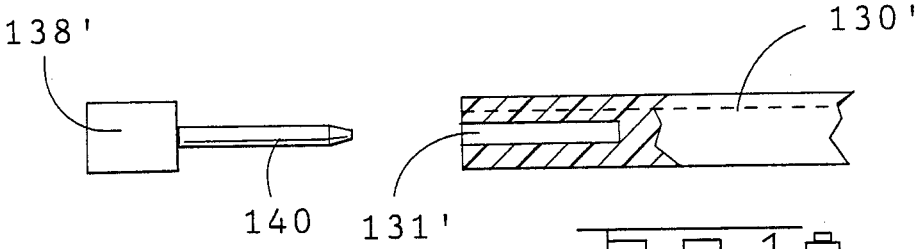
FIG. 18 is a schematic and side view of an alternative embodiment of the article of the invention wherein the wire retainer is plugged into the end of the structural element.
Figure 19:
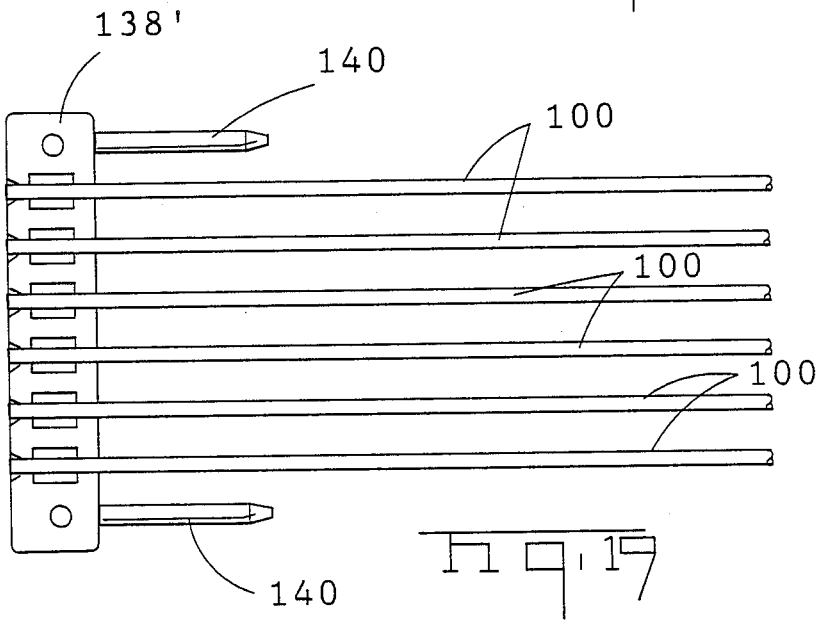
FIG. 19 is a plan view of the wire retainer utilized with the showing in FIG. 18.
Figure 20:
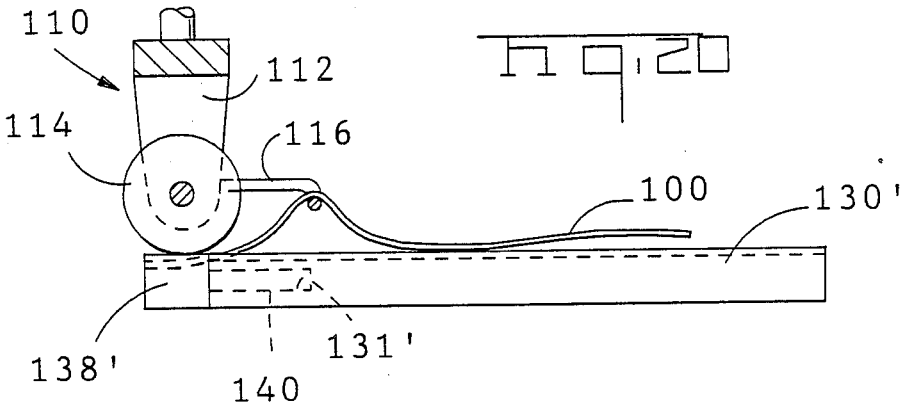
FIG. 20 is a schematic and side view of the elements of FIG. 18 and 19 in conjunction with the roller preparatory to wire implantation.

FIG. 18 shows an alternative embodiment of the invention wherein a frame shown as 130' is made to include a pair of recesses 131' at an end thereof. A wire retainer shown as 138' is made to include projections 140' which engage the apertures 131' and align the wire retainer 138' with the frame. The wire retainer 138' is otherwise similar to the wire retainer 138 heretofore discussed and works in a similar fashion except working from the end of the frame 130'. FIG. 20 shows a roller brought to bear against the upper surface of 138' preparatory to wire layment.

With respect to the FIGS. 14–20 and as heretofore mentioned, the wire retainer element may serve as a wire organizer without terminals or may serve as a connector having terminals. The invention contemplates both possibilities as well as the addition of terminals to the wire retainer element both before and after wire layment. It is also contemplated that more or less standard IDC connectors may be employed in conjunction with the invention, the frame being designed to accommodate such standard connectors fitted into apertures therein or plugged into end surfaces. Reference may be had to U.S. Pat. No. 4,159,158 and U.S. Pat. No. 4,435,035 wherein connectors suitable for such use are depicted.

In the disclosure heretofore given, the illustrative examples have included essentially a single wire retainer or wire retainer/connector in conjunction with a single structural member. It is contemplated that multiple wire retainers may be used with an individual structural member to achieve different wwiring patterns including on occasion, wiring patterns which have crossovers as is taught in our copending application 13905. It is also contemplated that multiple structural elements may be placed adjacent each other with multiple wiring retainers/connector attached thereto or plugged therein with wire rolling and layment taking place over the several individual elements.

Having now described the invention relative to drawings, we now set forth a definition of method and article in the appended claims.

We claim:

1. In a method of forming electrical wiring harnesses intended to interconnect components incorporated into structural units of apparatus, the steps comprising:

a. providing a first element forming a structural part of an apparatus served by the harness to be formed with grooves extending in a surface of said element in a pattern to form such harness, b. providing a second element including wire retention means, said second element having grooves aligned with the grooves of the first element, c. providing wires of sufficient lengths to fill the said grooves of said elements, d. inserting a segment of each wire into a groove of said second element, e. inserting the second element in an abutting engagement with the said first element whereby the said grooves are aligned, f. bringing wire driving means to bear against the surface of said second element, and g. causing relative movement between said wire driving means and said first and second elements to implant the wires in the grooves of said first element.

2. The method of claim 1 wherein there is an added step following the insertion of wires in the grooves of said second element, terminating said wires in said second element.

3. The method of claim 1 wherein there is the additional step of providing components carrying terminals and applying such components to said first element to terminate the wires in said grooves.

4. The method of claim 3 including as an additional step, mechanically securing said first and second elements together and affixing said first and second elements to the said apparatus.

5. The method of claim 1 wherein there is included as an additional step of applying terminals to the wires of the said second element prior to attachment of the said second element to the said first element.

6. The method of claim 1 wherein the said step of applying a wire driving means to said element embraces the use of a roller means.

7. The method of claim 6 wherein the said roller means is held fixed with the said first and second elements driven to move relative thereto.

8. The method of claim 1 wherein the said first element is made to include an aperture intermediate the ends thereof and the said second element is placed within said aperture with the said driving means applied to said second element and moved over the surface of the first element.

9. The method of claim 1 wherein the said first element is made to include means at the end thereof to receive said second element and the said second element is joined to said first element at said end with said driving means applied to said second element and moved over said first element in one direction.

10. The method of claim 1 wherein there is included the additional step of driving said wire driving means in first and second rotary directions to effect wire laying in first and second directions.

* * * * *